US007857071B1

(12) United States Patent
McCain et al.

(10) Patent No.: US 7,857,071 B1
(45) Date of Patent: Dec. 28, 2010

(54) GRADE INDICATOR FOR EXCAVATION OPERATIONS

(75) Inventors: Steven Daniel McCain, Tracy, CA (US); Richard John Jackson, Ormiston (AU)

(73) Assignee: Topcon Positioning Systems, Inc., Livermore, CA (US)

( * ) Notice: Subject to any disclaimer, the term of this patent is extended or adjusted under 35 U.S.C. 154(b) by 735 days.

(21) Appl. No.: 11/198,611

(22) Filed: Aug. 5, 2005

(51) Int. Cl.
*E02F 3/76* (2006.01)

(52) U.S. Cl. ..... 172/4.5; 701/50

(58) Field of Classification Search ..... 172/4.5, 172/200; 701/50; 33/293, 296
See application file for complete search history.

(56) References Cited

U.S. PATENT DOCUMENTS 4,807,131 A 2/1989 Clegg
5,375,663 A 12/1994 Teach
5,404,661 A * 4/1995 Sahm et al. ..... 37/348
5,631,658 A 5/1997 Gudat et al.
5,860,480 A 1/1999 Jayaraman et al.
5,905,968 A 5/1999 Staub et al.
5,961,573 A * 10/1999 Hale et al. ..... 701/214
6,112,145 A 8/2000 Zachman
6,133,826 A * 10/2000 Sparling ..... 340/436
6,166,802 A * 12/2000 Kodaira et al. ..... 356/4.08
6,191,732 B1 2/2001 Carlson et al.
6,655,465 B2 12/2003 Carlson et al.
6,736,216 B2 * 5/2004 Savard et al. ..... 172/1
6,816,761 B2 * 11/2004 Denton ..... 701/35
6,879,910 B2 * 4/2005 Shike et al. ..... 701/208
2003/0137658 A1 7/2003 Ohtomo et al.

* cited by examiner

*Primary Examiner*—Robert E Pezzuto
*Assistant Examiner*—Joel F. Mitchell
(74) *Attorney, Agent, or Firm*—Wolff & Samson PC

(57) ABSTRACT

A graphical grade indicator for use in earth moving operations has an improved, variable resolution and a substantially unlimited range. This grade indicator results in a more accurate indication of the position of a cutting blade relative to the desired grade and, as a result, allows a machine operator to more accurately control grading operations. In one embodiment, a graphical grade indicator has a graphical scale with a substantially unlimited range and various indications indicating a desired grade level and at least a first undesirable grade level. When the cutting blade deviates from the desired grade level, a first indication is provided indicating, illustratively, the direction and magnitude of movement of the cutting blade repositioning necessary to achieve the desired grade. The resolution of the graphical scale can be changed in order to provide a desired degree of accuracy in grading operations.

29 Claims, 5 Drawing Sheets

GRADE INDICATOR FOR EXCAVATION OPERATIONS

BACKGROUND OF THE INVENTION

The present invention relates generally to machine control, and more particularly to grade control in earth-moving operations.

Various types of machines, generally referred to herein as earthmoving machines, have been developed that alter the topology or geography of terrain. For example, scrapers, graders and bulldozers with an attached and moveable cutting blade may be used in various earthmoving applications. During construction site preparation, these machines may be used to level (or apply some predetermined slope, or grade) to the ground prior to construction of a building on the ground. Such earthmoving machines are also useful in road and other construction applications. Of course, there are various uses for scrapers, graders and bulldozers and other earthmoving machines.

Initially, the operation of earthmoving machines was performed by skilled operators in conjunction with a ground crew, for example a crew of grade correctors equipped with surveying instruments to ensure correct grading. This mode of operation continues to be in widespread use today. One disadvantage of this mode of operation is that it is time consuming and labor intensive. Accordingly, there have been various attempts at automating and precisely controlling grading and other operations of earthmoving machines. For example, navigation tools (such as laser systems and satellite based systems) have been employed to help automate these tasks. For example, U.S. Patent Application Publication 2003/0137658 A1 published Jul. 24, 2003, incorporated by reference herein in its entirety, discloses the use of a rotating laser in conjunction with a satellite based navigation system for use in controlling a bulldozer. Using such methods, the position of the bulldozer and the cutting blade can be precisely determined.

One of the constraints of existing systems is that, even though the position of the blade is known with a high degree of accuracy, it is often difficult for an operator of the scraper, grader or bulldozer or other earth-moving machine to determine with sufficient accuracy the position of the blade in relation to a desired grade. Prior attempts to provide indications of the position of the blade relative to the desired grade have typically involved placing a plurality of Light Emitting Diodes (LEDs) in a position viewable by the operator. However, such LED-based systems were typically limited in the range of indication of blade position that they could provide, therefore potentially resulting in inaccurate grading.

BRIEF SUMMARY OF THE INVENTION

The present invention provides a graphical grade indicator with an improved variable resolution and a substantially unlimited range. This grade indicator results in a more accurate indication of the position of a cutting blade relative to the desired grade and, as a result, allows a machine operator to more accurately control grading operations.

In one embodiment, a graphical grade indicator has a graphical scale with various indications indicating a desired grade level and at least a first undesirable grade level. The graphical scale has a substantially unlimited range and, therefore, provides a clearer indication to machine operators of exactly where the cutting blade is positioned relative to the desired grade. When the cutting blade deviates from the desired grade level, a first indication is provided indicating, illustratively, the direction and magnitude of the cutting blade repositioning necessary to achieve the desired grade.

In another embodiment the resolution of the graphical grade indicator can be changed in order to provide a desired degree of accuracy in determining whether the cutting blade of an earth moving machine is positioned at a desired grade level.

These and other advantages of the invention will be apparent to those of ordinary skill in the art by reference to the following detailed description and the accompanying drawings.

DETAILED DESCRIPTION

Figure 1:
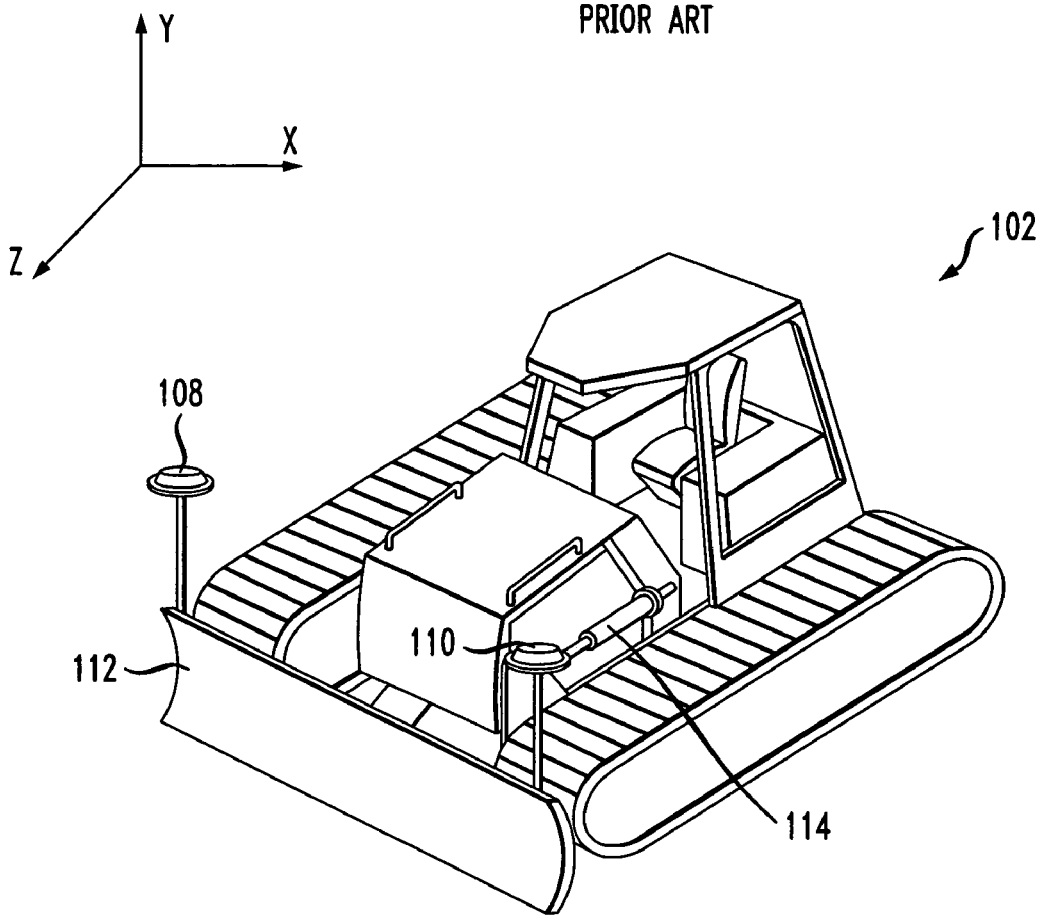
FIG. 1 PRIOR ART
FIG. 1 shows an earth moving machine in accordance with one embodiment of the invention.

FIG. 1 shows a construction machine 102 in accordance with one embodiment of the present invention. Specifically, that figure shows a bulldozer adapted to perform various earthmoving operations, including performing grading operations, as discussed above. As would be readily apparent to one skilled in the art, the principles of the present invention are applicable to other types of construction machines as well. Construction machine 102 has, illustratively, two satellite antennas 108 and 110 that are used to receive signals from Global Navigation Satellite Systems (GNSS). GNSS are well known and used to solve a wide variety of positioning/time related tasks. Two well known such systems are the Global Positioning System (GPS) of the United States and the GLOBal NAvigation Satellite System (GLONASS) of Russia. For ease of reference, this description will generally refer to the GPS system, but it is to be understood that the present description is equally applicable to GLONASS, combined GPS+GLONASS, or other GNSS systems.

GPS antennas 108 and 110 are connected to the blade 112 of the bulldozer 102. The blade 112 of the bulldozer 102 is controlled by at least one hydraulic cylinder 114. In one particular embodiment, the bulldozer 102 comprises a hydraulic cylinder 114 for lifting the blade 112 and a hydraulic cylinder (not shown) for tilting (i.e., rotating around the longitudinal axis of the bulldozer) the blade 112. The valve that controls the lifting cylinder is referred to as the lifting valve, and the valve that controls the tilting cylinder is referred to as the tilting valve. The configuration of a bulldozer blade and its controlling cylinders is well known in the art and will not be described in further detail herein.

One skilled in the art will recognize that the position of each of GPS antennas 108 and 110 can be located with a high degree of precision. The precision can be further enhanced using differential GPS, or DGPS, which is well known. Such DGPS methods allow the position of antennas 108 and 110 to be determined within, for example, 2 cm vertically, along the y-axis in FIG. 1, and within, also by way of example, 1 cm laterally, along the x and z axes in FIG. 1. As one skilled in the art will recognize, the bulldozer configuration described above allows for the measurement of the Cartesian and angular position of the bulldozer body frame as well as its linear and angular velocities. Particularly, using such high-precision location techniques as DGPS permits the location and orientation of both the bulldozer 102 and the blade 112 with great accuracy. More specifically, knowing the positions of antennas 108 and 110 permit the precise position and orientation of the cutting edge of blade 112 to be known, which in turn allows the heading and position of the bulldozer 102 to be determined. As one skilled in the art will appreciate, two antennas 108 and 110 may be desirable on blade 112 so as to permit the determination of the slope at which the bulldozer is oriented vs. the ground. For example, if one of antennas 108 and 110 is higher than the other antenna, then it can be determined that the bulldozer is sitting on a sloped surface. Alternatively, a single antenna can be used on the blade 112 in conjunction with a well known tilt sensor in order to determine the position of the bulldozer and the slope upon which the bulldozer is resting or moving. One skilled in the art will be able to devise various equally advantageous placements and configurations of GNSS antennas in order to determine the positions and orientations of bulldozer 102 and blade 112 as described above.

Figure 2:
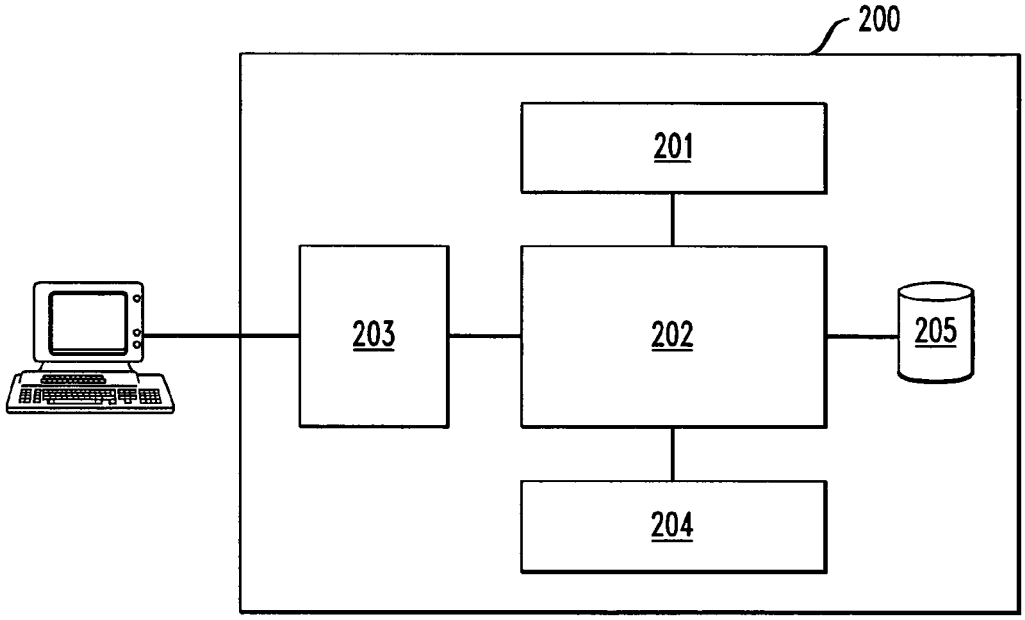
FIG. 2 PRIOR ART
FIG. 2 shows a computer adapted to generate a graphical grade indicator in accordance with the principles of the present invention.

One skilled in the art will recognize that the antennas 108 and 110 of FIG. 1 may be connected to a GNSS control system which may be implemented on a programmable computer adapted to perform the steps of a computer program to calculate and display the position of the earth moving machine and/or the cutting blade. Referring to FIG. 2, such a control system 200 may be implemented on any suitable computer adapted to receive, store and transmit data such as data associated with the aforementioned antenna locations. Specifically, illustrative control system 200 may have, for example, a processor 202 (or multiple processors) which controls the overall operation of the control system 200. Such operation is defined by computer program instructions stored in a memory 203 and executed by processor 202. The memory 203 may be any type of computer readable medium, including without limitation electronic, magnetic, or optical media. Further, while one memory unit 203 is shown in FIG. 2, it is to be understood that memory unit 203 could comprise multiple memory units, with such memory units comprising any type of memory. Control system 200 also comprises illustrative modem 201 and network interface 204. Control system 200 also illustratively comprises a storage medium, such as a computer hard disk drive 205 for storing, for example, data and computer programs adapted for use in accordance with the principles of the present invention as described hereinabove. Finally, control system 200 also illustratively comprises one or more input/output devices, represented in FIG. 2 as terminal 206, for allowing interaction with, for example, a technician or machine operator. One skilled in the art will recognize that control system 200 is merely illustrative in nature and that various hardware and software components may be adapted for equally advantageous use in a computer in accordance with the principles of the present invention.

Figure 3:
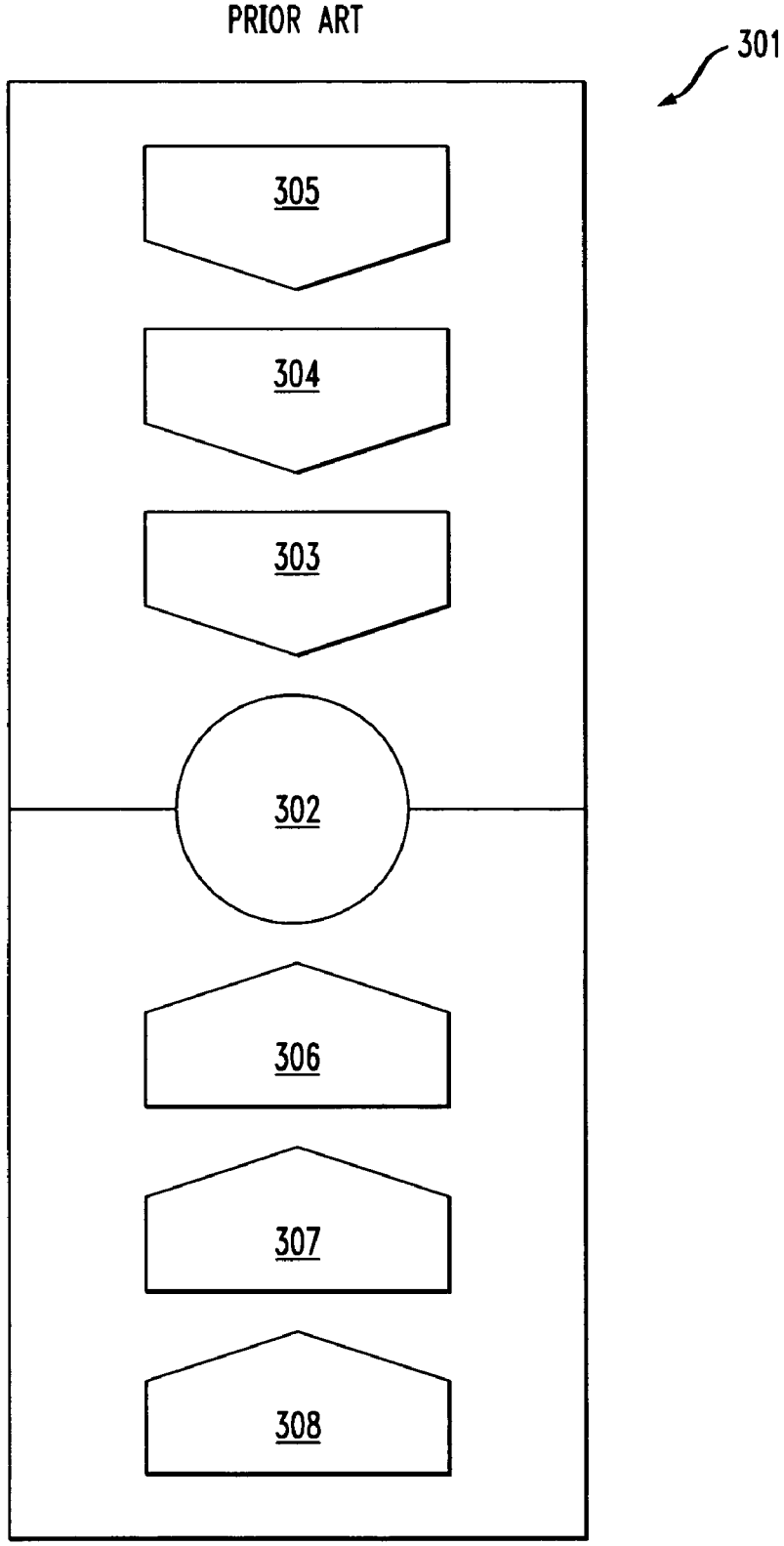
FIG. 3 PRIOR ART
FIG. 3 shows a prior art LED grade display indicator.

Bulldozers, such as bulldozer 102 in FIG. 1 can be used for various earthmoving operations, such as for grading operations as discussed above. However, in order to accurately perform such grading operations, an operator of a bulldozer or other grading machine must be able to determine the position of the cutting blade 112 relative to the desired grade with a high degree of accuracy. Making such a determination can be difficult. As discussed above, some prior methods of ensuring accurate grading operations involved using a crew of grade correctors equipped with surveying instruments. This mode of operation continues to be in widespread use today but is disadvantageous in that it is time consuming and labor intensive. With the advent of GPS methods for determining grade, various methods of providing indications to the operator to allow that operator to control the machine and to perform grading operations with the desired accuracy. Specifically FIG. 3 shows one illustrative prior indication system for providing a visual cue to the operator of a grading machine, such as bulldozer 102 in FIG. 1. Specifically, FIG. 3 shows a grading indicator 301 having a plurality of light emitting diodes (LEDs) 302-308 for providing an indication to the operator of whether the cutting blade 112 of bulldozer 102 in FIG. 1 is at the proper grade position, is above that position, or is below that position. Specifically, the grading indicator 301 of FIG. 3 shows a center LED 302 with LEDs 303, 304 and 305 being positioned above and progressively further away from the center LED 302. Similarly, LEDs 306, 307 and 308 are below and progressively further away from center LED 302. During grading operations, a well-known GPS system controller, such as the controller connected to antennas 104-110 in FIG. 1 above, is used to determine the position of those antennas, and to compare the position of cutting blade 112 to the predetermined desired grade. If the position of the cutting blade is the position of the desired grade level, then the center LED 302 is illuminated. However, if the position of the cutting blade is above the position necessary to result in this desired grade, then one of the LEDs 303-305 above the center LED 302 would be illuminated. For example, if the cutting blade was slightly above the desired grade, LED 303 may be illuminated thus indicating to the equipment operator that the cutting blade needed to be lowered to reach the desired grade. If the cutting blade was located more significantly above the desired grade, then either LED 304 of LED 305 would be illuminated. The higher the LED illuminated, the more the cutting blade 112 is above the desired grade and the greater the distance the cutting blade would have to be lowered to achieve the desired grade.

A similar illumination progression is illustratively applied if cutting blade 112 is below the desired grade. For example, if the cutting blade was slightly below the desired grade, LED 306 may be illuminated thus indicating to the equipment operator that the cutting blade needed to be raised slightly to reach the desired grade. If the cutting blade was located more significantly below the desired grade, then either LED 307 of LED 308 would be illuminated. The lower the LED illuminated relative to LED 302, the more the cutting blade 112 is below the desired grade and the greater the distance the cutting blade would have to be raised to achieve the desired grade.

While an LED-based system for providing grading indications to an equipment operator, such as the LED system 301 shown in FIG. 3, is advantageous in certain implementations, it is also disadvantageous in some regards. Most significantly, such a system is somewhat inaccurate, has a fixed resolution and only provides a limited range of grade indications. In particular, each LED in the display 301 represents a range of grades. For example, the center LED 302 may be illuminated if the cutting blade 112 is +/−0.1 feet from the desired grade. LED 303 may represent the condition where the blade is between 0.1 and 0.2 feet above the desired grade. Similarly, LEDs 304 and 305 may represent the ranges 0.2-0.3 feet and 0.3-0.5 feet above grade, respectively. A similar range may apply to each corresponding LED below LED 302 as well.

This resolution, in this case of one-tenth of a foot, cannot typically be changed or, if it can be changed, is not always clearly indicated on the LED display. As a result, the illumination of a particular LED cannot always be used to determine if the blade is 0.25 or 0.27 feet above or below grade, for example. Additionally, a deviation above or below 0.5 feet from the desired grade cannot be indicated—typically, in such a case, either LED 305 or LED 308 will remain lit until the cutting blade is brought back within 0.3 feet of grade, at which point LED 307 will be lit. In some uses, knowing the grade within, for example, one tenth of a foot in a range of 0.5 feet above or below grade is adequate. However, when the above-described GNSS systems are used, especially when those systems are enhanced with the DGPS methods also described above, a significantly greater accuracy in measurement within a significantly broader range is possible.

Therefore, the present inventors have invented a graphical grade indication display with an improved variable resolution and a substantially unlimited range. Specifically, referring to FIG. 4, display 401 is a graphical display showing a graphical representation 402 of the position of the cutting blade of, for example, a bulldozer, such as, illustratively, bulldozer 101 in FIG. 1, or any other suitable earth moving machine. Display 401 is a display, for example, displayed on a monitor such as that shown in terminal 206 in FIG. 2. Illustratively, this monitor is positioned in such a way that it is viewable by the operator of the earth moving machine. Referring once again to FIG. 4, display 401 shows a graphical representation 402 of the cutting blade of the earth moving machine. Line 403 represents the desired grade level. This level is also indicated as a number 404, here 0.5 feet above a predetermined level, indicated here as level 407, on graphical scale 405. The desired grade can also be indicated as a range, such as range 406 which, on graphical scale 405, represents a range of between 0.4 and 0.6 feet above level 407. This range may be indicated by an area of different color, such as area 411 on graphical scale 405. Graphical scale 405 has a plurality of gradations that represent measurements and is referred to herein as a virtual tape. Each gradation in graphical scale 405 represents, illustratively, $1/10^{th}$ of a foot.

In grading operations, pointer 408 points to the gradation on virtual tape 405 corresponding to the current position of the blade relative to the desired grade. Specifically, in FIG. 4, 0.5 feet above level 407 is the desired grade as represented by range 406 and dotted line 403. Arrows 409 and 410 are used to provide an indicator to the operator of the bulldozer as to whether the blade of that machine should be maintained in the current position or whether it should be repositioned up or down. Specifically, in the illustrative case of FIG. 4, both arrows 409 and 410 are visible and, illustratively illuminated with a particular color, for example green, indicating that the pointer 408 is in the desired position relative to the graphical scale 405 and, hence, the graphical representation 402 shows that the cutting blade is in the desired grade position.

Figure 4:
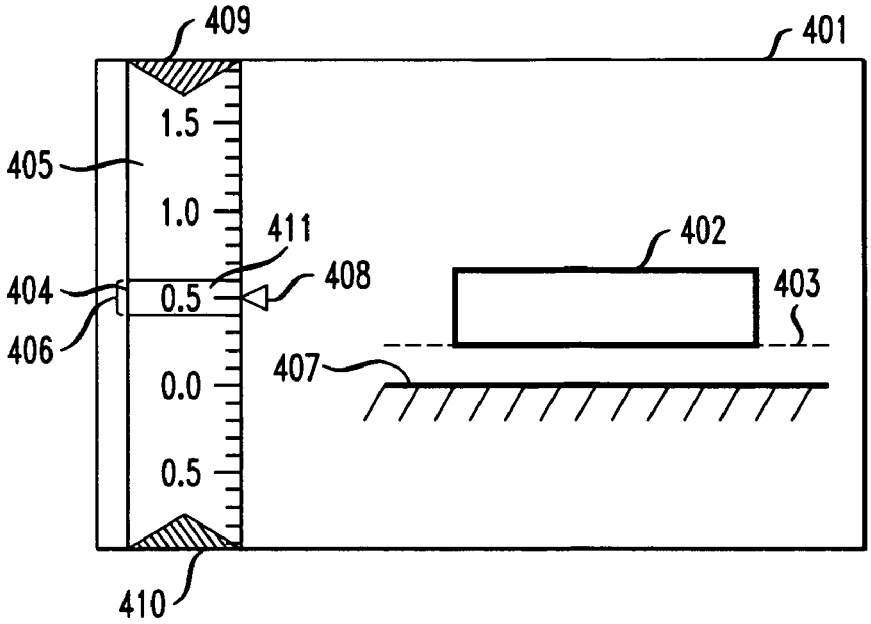
FIG. 4 shows a graphical grade indicator in accordance with an embodiment of the present invention.
Figure 5:
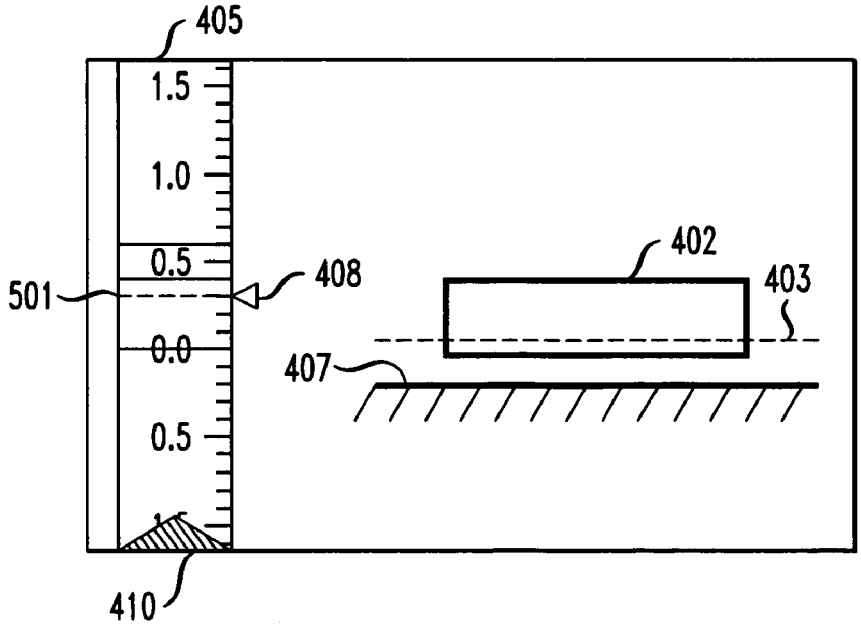
FIG. 5 shows the graphical grade indicator of FIG. 4 wherein the cutting blade of an earth moving machine is below a desired grade level.

During operations, the graphical representation 402 of the blade of FIG. 4 may deviate from the desired grade position. For example, FIG. 5 shows the situation where the graphical representation 402 of the cutting blade drops below the position relative to level 407 that will produce the desired grade. Specifically, once again, the desired grade is expressed as being between 0.4-0.6 feet above level 407. However, in FIG. 5, the graphical representation 402 of the cutting blade has dropped below the desired grade, represented by dotted line 403. Additionally, this drop below desired grade is indicated by pointer 408 being positioned below the desired range 406 on graphical scale 405. Specifically, pointer 408 in FIG. 5 is positioned at level 501 which is, for example, 0.3 feet. When the blade drops below the desired grade level, arrow 409 in FIG. 4 may illustratively disappear and arrow 410, which is pointing up, may illustratively change color, for example to red or yellow, to provide a clear indication that the blade of the bulldozer needs to be raised.

Figure 6:
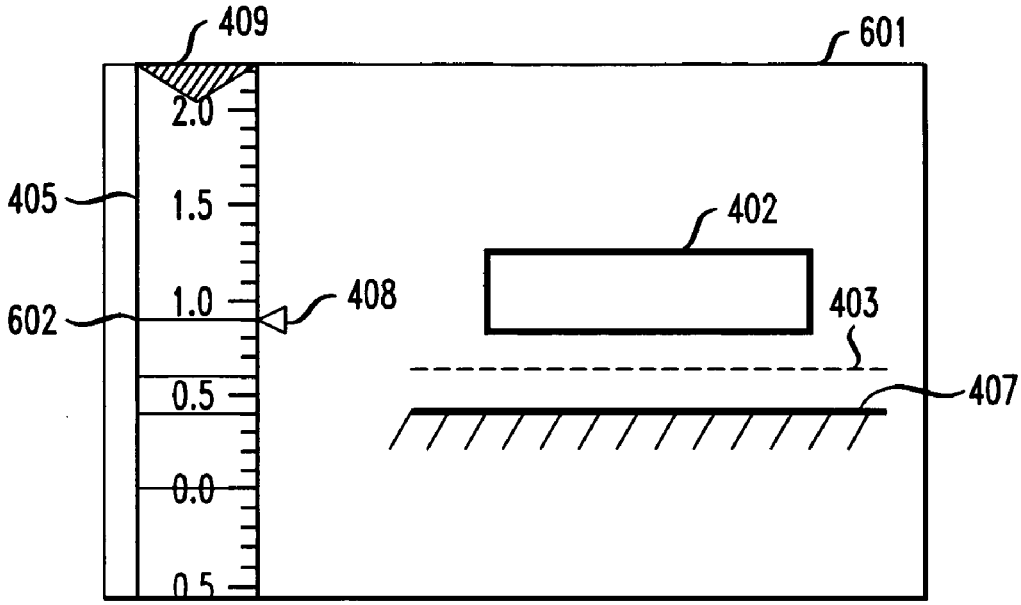
FIG. 6 shows the graphical grade indicator of FIG. 4 wherein the cutting blade of an earth moving machine is above a desired grade level.

FIG. 6 shows another example of how the display of FIG. 4 may change during grading operations to indicate a need to change the position of the blade 402. In particular, in FIG. 6, the blade is above grade and, thus, lowering of the graphical representation 402 of the cutting blade is required. As indicated by the display 601, the graphical representation 402 of the cutting blade is shown at a position above the desired grade position represented by dotted line 403. Correspondingly, as shown in graphical scale 405, pointer 408 is positioned at position 602, which is 0.9 feet above surface 407. Since this is 0.4 feet above the desired grade level, arrow 409 is illuminated, once again with a noticeable color such as yellow or red, to provide a clear indication to the operator that the cutting blade has to come down to be aligned with the desired grade.

Accordingly, the graphical scale 405 of FIGS. 4, 5 and 6 shows how clear indications of blade position and required adjustments can be provided to an earthmoving equipment operator. Graphical scale 405 is not limited to a predetermined number of LEDs, for example, as some prior attempts were limited. Instead, graphical scale 405 is a virtual tape created by a computer, such as the illustrative computer of FIG. 2, and is displayed on a display device such as associated with terminal 206 of that figure. Therefore, graphical scale 405 is virtually unlimited in range. Unlike prior attempts, therefore, there is no limit to the distance from grade that may be indicated by graphical scale 405. The virtual tape will continue to scroll to the appropriate deviation from grade to provide the operator with a clear indication of how far from grade the blade is located and in which direction the operator must move the blade. Accordingly, a clearer indication of grading operations is provided, thus increasing the ease of operation of earth moving equipment, such as bulldozers.

Figure 7:
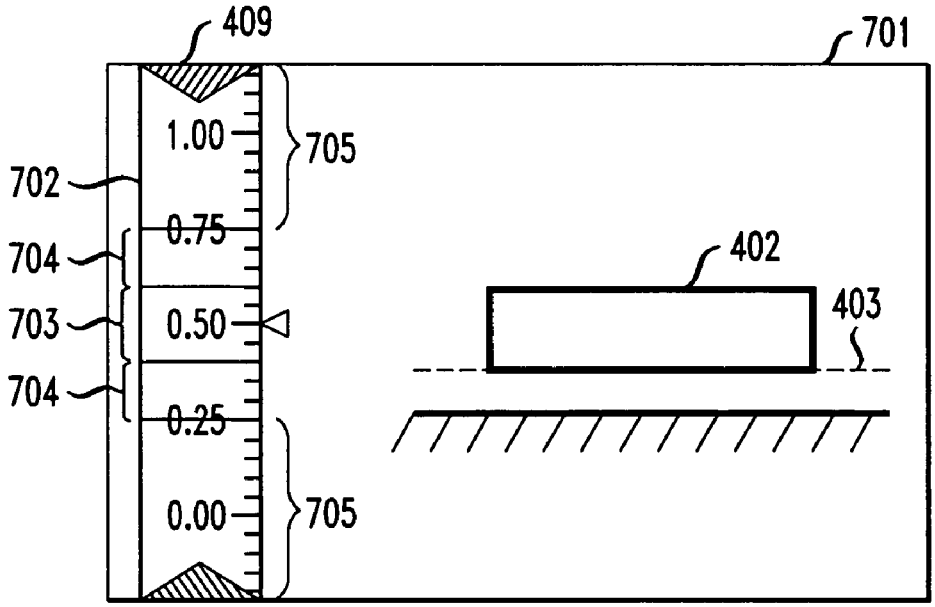
FIG. 7 shows the graphical grade indicator of FIG. 4 having a variable resolution graphical scale.

Since the graphical scale 405 of FIGS. 4, 5 and 6 consists of a virtual tape, it is also possible to vary other attributes of the scale. For example, FIG. 7 shows how the resolution of the graphical scale can be altered in order to provide a finer degree of control over grading operations. Referring to FIG. 7, display 701 is showing the graphical representation 402 of the cutting blade which is, once again, a blade on an earth moving machine such as a bulldozer. As shown in FIG. 7, the graphical representation 402 of the cutting blade is located at a desired grade level represented by dotted line 403. However, in FIG. 7, graphical scale 702 has an increased resolution. In particular, instead of each gradation on the graphical scale representing 0.1 feet, as in FIGS. 4, 5 and 6, the graphical scale 702 has gradations representing 0.05 feet. Such an increased resolution of graphical scale 702 may be selectable, for example, by the equipment operator to enable a finer degree of control over the grading operations.

Other variations to the graphical scale may also be used to provide to enhance the grade indicators as described above. For example, referring once again to FIG. 7, the graphical scale 702 may also vary in color depending on the position of the pointer relative to the desired grade. For example, in FIG. 7, range 703 may be colored green, thus indicating that blade 402 is at the desired grade level. Ranges 704, on the other hand may be colored yellow to indicate that, if the pointer is pointed to a level within these areas, the cutting blade is somewhat above or below the desired grade level. Finally, ranges 705 may be colored red to indicate that, if the pointer is within these areas, the cutting blade is significantly above or below the desired grade level. Any deviation from the desired grade level may also be indicated by other means, such as by an audio indication, such as a bell, chime or any other appropriate audio signal. Different audio indications may be used depending on where the pointer is located relative to the desired grade level.

The foregoing Detailed Description is to be understood as being in every respect illustrative and exemplary, but not restrictive, and the scope of the invention disclosed herein is not to be determined from the Detailed Description, but rather from the claims as interpreted according to the full breadth permitted by the patent laws. It is to be understood that the embodiments shown and described herein are only illustrative of the principles of the present invention and that various modifications may be implemented by those skilled in the art without departing from the scope and spirit of the invention.

The invention claimed is:

1. A grade indicator for use in earth grading operations using earth moving equipment comprising:

a scrolling graphical scale;

a first indicator on said scrolling graphical scale indicating a desired grade range, said first indicator comprising an area of color different from a color outside the area, said area bounded between two points on said scrolling graphical scale, one point being an upper-bound of the desired grade range and one point being a lower-bound of the desired grade range;

a second indicator for providing an indication on said scrolling graphical scale of a position of a cutting blade on an earth moving machine; and a third indicator for providing an indication that said cutting blade is not within said desired grade range.

2. The grade indicator of claim 1 wherein said scrolling graphical scale has a substantially unlimited range.

3. The grade indicator of claim 1 wherein said scrolling graphical scale has a variable resolution.

4. The grade indicator of claim 3 wherein said variable resolution is selectable by an operator of said earth moving equipment.

5. The grade indicator of claim 1 wherein said scrolling graphical scale comprises a plurality of gradations, each gradation in said plurality representing a distance from said desired grade range.

6. The grade indicator of claim 1 wherein said first indicator comprises a line on said scrolling graphical scale, said line positioned at a location on said scrolling graphical scale representative of a desired grade level.

7. The grade indicator of claim 1 wherein said second indicator comprises a pointer for pointing to a gradation on said scrolling graphical scale.

8. The grade indicator of claim 7 wherein said pointer is a computer-generated pointer.

9. The grade indicator of claim 1 wherein said second indicator comprises a first graphical representation of said cutting blade and a second graphical representation of a desired grade level relative to said cutting blade.

10. The grade indicator of claim 1 wherein said third indicator comprises an arrow for indicating a direction in which said cutting blade should be moved to be within said desired grade range.

11. The grade indicator of claim 1 wherein said third indicator comprises an audible indicator for indicating said cutting blade is not within said desired grade range.

12. The grade indicator of claim 11 wherein said audible indicator comprises a first audible indicator when said cutting blade is at a first grade level and a second audible indicator when said cutting blade is at a second grade level.

13. The grade indicator of claim 1 wherein said scrolling graphical scale is generated by a computer and is displayed on a computer display.

14. A method for displaying a graphical indicator for use in grade operations with an earthmoving machine, said method comprising:

generating a display of a scrolling graphical scale;

generating a first indicator on said scrolling graphical scale indicating a desired grade range, said first indicator comprising an area of color on said scrolling graphical scale different from a color outside the area, said area bounded between two points on said display of a scrolling graphical scale, one point being an upper-bound of the desired grade range and one point being a lower-bound of the desired grade range;

generating a second indicator, said second indicator representing a position of a cutting blade on an earth moving machine;

determining whether said position of said cutting blade is within said desired grade range; and if said cutting blade is not within said desired grade range, generating a third indicator indicating that said cutting blade is not within said desired grade range.

15. The method of claim 14 wherein said step of generating a display of a scrolling graphical scale comprises:

receiving an indication representative of a desired resolution of said scrolling graphical scale; and in response to said indication, generating said scrolling graphical scale having said desired resolution.

16. The method of claim 14 wherein said step of generating a display of a scrolling graphical scale comprises generating a scale having a substantially unlimited range.

17. The method of claim 14 wherein said step of generating a first indicator comprises generating a graphical representation of a line on said scrolling graphical scale, said line generated at a position on said scrolling graphical scale representative of a desired grade level.

18. The method of claim 14 wherein said step of generating a second indicator comprises generating a pointer for pointing to a gradation on said scrolling graphical scale.

19. The method of claim 14 wherein said step of generating a second indicator comprises generating a first graphical representation of said cutting blade and a second graphical representation of a desired grade level relative to said cutting blade.

20. The method of claim 14 wherein said step of generating a third indicator comprises generating an arrow for indicating a direction in which said cutting blade should be moved to be within said desired grade range.

21. The method of claim 14 wherein said step of generating a third indicator comprises generating an audible indicator for indicating said cutting blade is not within said desired grade range.

22. An apparatus for use in displaying a graphical indicator used in grade operations with an earthmoving machine, said apparatus comprising:

means for generating a display of a scrolling graphical scale;

means for generating a first indicator on said scrolling graphical scale indicating a desired grade range, said first indicator comprising an area of color different from a color outside the area, said area bounded between two points on said scrolling graphical scale, one point being an upper-bound of the desired grade range and one point being a lower-bound of the desired grade range;

means for generating a second indicator, said second indicator representing a position of a cutting blade on an earth moving machine;

means for determining whether said position of said cutting blade is within said desired grade range; and means for generating a third indicator indicating that said cutting blade is not within said desired grade range.

23. The apparatus of claim 22 wherein said means for generating a display of a scrolling graphical scale comprises:

means for receiving an indication representative of a desired resolution of said scrolling graphical scale; and means for generating, in response to said indication, said scrolling graphical scale having said desired resolution.

24. The apparatus of claim 22 wherein said means for generating a display of a scrolling graphical scale comprises means for generating a scale having a substantially unlimited range.

25. The apparatus of claim 22 wherein said means for generating a first indicator comprises means for generating a graphical representation of a line on said scrolling graphical scale, said line generated at a position on said scrolling graphical scale representative of a desired grade level.

26. The apparatus of claim 22 wherein said means for generating a second indicator comprises means for generating a pointer for pointing to a gradation on said scrolling graphical scale.

27. The apparatus of claim 22 wherein said means for generating a second indicator comprises means for generating a first graphical representation of said cutting blade and a second graphical representation of a desired grade level relative to said cutting blade.

28. The apparatus of claim 22 wherein said means for generating a third indicator comprises means for generating an arrow for indicating a direction in which said cutting blade should be moved to be within said desired grade range.

29. The apparatus of claim 22 wherein said means for generating a third indicator comprises means for generating an audible indicator for indicating said cutting blade is not within said desired grade range.

* * * * *